US009199356B2

(12) United States Patent
Liversage

(10) Patent No.: US 9,199,356 B2
(45) Date of Patent: Dec. 1, 2015

(54) CUTTING ELEMENT

(75) Inventor: John Hewitt Liversage, Gauteng (ZA)

(73) Assignee: ELEMENT SIX ABRASIVES S.A., Luxembourg (LU)

( * ) Notice: Subject to any disclaimer, the term of this patent is extended or adjusted under 35 U.S.C. 154(b) by 164 days.

(21) Appl. No.: 13/330,188

(22) Filed: Dec. 19, 2011

(65) Prior Publication Data

US 2012/0159865 A1 Jun. 28, 2012

Related U.S. Application Data

(60) Provisional application No. 61/425,944, filed on Dec. 22, 2010.

(30) Foreign Application Priority Data

Dec. 22, 2010 (GB) ..... 1021729.7

(51) Int. Cl.

| | |
|---|---|
| ***B24D 3/00*** | (2006.01) |
| ***B24D 3/04*** | (2006.01) |
| ***B24D 11/00*** | (2006.01) |
| ***B24D 18/00*** | (2006.01) |
| ***C09K 3/14*** | (2006.01) |
| ***B24D 3/06*** | (2006.01) |

(52) U.S. Cl.
CPC . *B24D 3/06* (2013.01); *B24D 18/00* (2013.01)

(58) Field of Classification Search
USPC ..... 51/297, 293, 307, 309
See application file for complete search history.

(56) References Cited

U.S. PATENT DOCUMENTS

| | | | | |
|---|---|---|---|---|
| 4,382,477 | A * | 5/1983 | Barr | 175/428 |
| 4,629,373 | A | 12/1986 | Hall | |
| 4,764,434 | A | 8/1988 | Aronsson et al. | |
| 5,032,147 | A * | 7/1991 | Frushour | 51/309 |
| 5,607,024 | A * | 3/1997 | Keith et al. | 175/431 |
| 5,662,720 | A * | 9/1997 | O'Tighearnaigh | 51/295 |
| 5,887,580 | A | 3/1999 | Eyre | |
| 6,068,913 | A | 5/2000 | Cho et al. | |
| 6,105,694 | A | 8/2000 | Scott | |
| 7,435,377 | B2 * | 10/2008 | Cho et al. | 419/14 |

(Continued)

FOREIGN PATENT DOCUMENTS

| | | | |
|---|---|---|---|
| EP | 786300 | A1 | 7/1997 |
| GB | 2461198 | A1 | 12/2009 |

(Continued)

*Primary Examiner* — James McDonough
(74) *Attorney, Agent, or Firm* — Bryan Cave LLP

(57) ABSTRACT

A cutting element is described comprising a super-hard cutting table, a substrate and a metal or alloy layer. A surface of the superhard cutting table, is joined to the substrate by means of the metal or alloy layer which is positioned between them. At least a first surface of the metal or alloy layer and at least a first surface of the cutting table are co-operatively shaped with each other such that the co-operative shaping substantially prevents relative movement between the cutting table and the metal or alloy layer.

10 Claims, 4 Drawing Sheets

(56) References Cited

U.S. PATENT DOCUMENTS

| | | | | |
|---|---|---|---|---|
| 7,487,849 | B2 | 2/2009 | Radtke | |
| 7,493,972 | B1 | 2/2009 | Schmidt et al. | |
| 7,533,740 | B2 * | 5/2009 | Zhang et al. | 175/432 |
| 2006/0060391 | A1 | 3/2006 | Eyre et al. | |
| 2006/0254830 | A1 | 11/2006 | Radtke et al. | |
| 2006/0266558 | A1 | 11/2006 | Middlemiss et al. | |
| 2008/0185189 | A1 | 8/2008 | Griffo et al. | |
| 2010/0126779 | A1 | 5/2010 | Corbett et al. | |
| 2010/0243336 | A1 | 9/2010 | Dourfaye et al. | |
| 2010/0270088 | A1 * | 10/2010 | Zhang et al. | 175/434 |
| 2013/0263522 | A1 * | 10/2013 | Nilen et al. | 51/307 |

FOREIGN PATENT DOCUMENTS

| | | | |
|---|---|---|---|
| WO | 9929465 | A1 | 6/1999 |
| WO | 0222311 | A1 | 3/2002 |
| WO | 2007042920 | A1 | 4/2007 |
| WO | 2008012781 | A1 | 1/2008 |
| WO | 2008015622 | A2 | 2/2008 |
| WO | 2010117834 | A1 | 10/2010 |

* cited by examiner

CUTTING ELEMENT

FIELD

This disclosure relates generally to a cutting element comprising a super-hard cutting table secured to a substrate. Some embodiments relate to structural features of the cutting element that form the join between the super-hard cutting table and the substrate. Other embodiments relate to methods of securing the super-hard cutting table to the substrate to make the cutting element.

BACKGROUND

Cutting elements comprising superhard cutting tables are used extensively in cutting, milling, grinding, drilling and other abrasive operations. For example, such cutting elements are widely used within drill bits used for boring into the earth in the oil and gas drilling industry.

Superhard cutting tables typically consist of a mass of superhard particles, typically diamond or cubic boron nitride, bonded into a coherent, polycrystalline conglomerate. As an example, polycrystalline diamond (PCD) is a super-hard material comprising a mass of inter-grown diamond grains and interstices between the diamond grains. PCD is typically made by subjecting an aggregated mass of diamond grains to an ultra-high pressure and temperature. Material wholly or partly filling the interstices is referred to as filler or binder material. PCD is typically formed in the presence of a sintering aid, which promotes the inter-growth of diamond grains. The sintering aid is commonly referred to as a solvent/catalyst material for diamond, owing to its function of dissolving diamond to some extent and catalysing its re-precipitation. A solvent/catalyst for diamond is understood to be a material capable of promoting the growth of diamond and the formation of direct diamond-to-diamond bonds at a temperature and pressure at which diamond is thermodynamically stable. As examples of solvent/catalyst materials there may be mentioned cobalt, iron, nickel, and manganese, and alloys including one or more of these materials. Consequently, the interstices within the sintered PCD product are typically wholly or partially filled with residual solvent/catalyst material.

It is common for superhard cutting tables to be supported on a support or substrate of some kind. For example it is known for superhard cutting tables to be supported on a cemented carbide substrate or support. This substrate provides a convenient means for attachment of cutting element comprising the cutting table and substrate within a tool body. It may also advantageously provide support in cases where the superhard cutting table is brittle. A typical cutting element incorporating a superhard cutting table comprises a disc shaped cutting table, for example a disc shaped PCD table, on a generally cylindrical substrate, e.g. a generally cylindrical cemented carbide substrate, e.g. tungsten carbide substrate. The substrate may have the same or similar diameter to the disc-shaped cutting element. The cemented carbide substrate may itself contain a binder material, for example cobalt, nickel, iron, manganese, or an alloy of one or more of these materials.

The term cutting "table" is used extensively in the field. While the structure of such a table in the field is commonly a substantially flat disc, no particular shape is required for the cutting "table", other than that of a shape capable of providing a surface which can apply a cutting or abrasive action.

Superhard cutting tables are often produced by placing the components necessary to form the cutting table in particulate form on a substrate in a reaction capsule, which is then placed in the reaction zone of a high pressure/high temperature apparatus, and subjected to high pressure and high temperature (HPHT). For example superhard particles, e.g. diamond particles, may be placed in combination with solvent/catalyst particles, e.g. cobalt, on a substrate, e.g. a cemented tungsten carbide substrate, in such a capsule, and subjected to HPHT. During the HPHT treatment, the catalyst/solvent material particles in the component mix, and/or also any binder materials present in the cemented carbide substrate, e.g. cobalt or the like, may migrate through and/or into the mass of superhard particles to act as a catalyst, these catalyst/solvent materials causing the ultrahard particles to bond to one another. Once manufactured the cutting element comprises a cemented carbide layer and a cutting "table" layer, the latter comprising a coherent matrix of superhard particles (e.g. diamond particles) bonded to one another with interstices containing binder material between those superhard particles. The production of cutting tables supported on a substrate in this way is described in many references, for example, in WO 2008/015622, US 2006/0060391, and U.S. Pat. No. 7,533,740.

It is also known in the art, e.g. from WO 2008/015622, that increased presence of solvent/catalyst material in the superhard element can compromise the thermal stability of the cutting element. Treatments to mitigate this are known. For example US 2006/0060391 describes treatment of a PCD body by removing substantially all of the catalyst material from a selected region of the body by a suitable process, e.g. acid leaching, aqua regia bath, electrolytic process, or combinations thereof.

WO2010/117834 and U.S. Pat. No. 7,533,740 are examples of references which describe securement of preformed thermally stable diamond cutting tables to substrates.

U.S. Pat. No. 7,487,849 describes a cutting element that includes a substrate, a thermally stable polycrystalline diamond layer and a metal interlayer between the substrate and the diamond layer, and a braze joint securing the diamond layer to the substrate. The metal interlayer may be of a suitable thickness to provide a shock absorbing ability to the cutting element.

SUMMARY

Viewed from one aspect there is provided a cutting element comprising a super-hard cutting table, a substrate and a metal or alloy layer; the superhard cutting table, the substrate and the metal or alloy layer each having a first surface, the said first surface of the cutting table being joined to the said first surface of the substrate by means of the metal or alloy layer, the metal or alloy layer being located between the said first surfaces of the super-hard cutting table and the substrate so that the first surface of the metal or alloy layer faces the first surface of the cutting table, and at least the first surface of the metal or alloy layer and at least the first surface of the cutting table being co-operatively shaped with each other such that the co-operative shaping substantially prevents relative movement between the cutting table and the metal or alloy layer.

Viewed from another aspect there is provided a method of forming a join between a super-hard cutting table and a substrate using a metal or alloy layer, the super-hard cutting table, the substrate and the metal or alloy layer each having a first surface, and the metal or alloy layer having an opposing surface, the method comprising: (i) forming one or more depressions and/or projections in the first surface of the superhard cutting table; (ii) forming at least the first surface of the metal or alloy layer so as to follow the or each depression and/or projection that is in the first surface of the superhard cutting table so as to form an interference fit between the metal or alloy layer and the superhard cutting table or the substrate or both; and (iii) bonding the opposing surface of the metal or alloy layer to the first surface of the substrate. Thereby, the first surface of the cutting table is secured to the first surface of the substrate Viewed from another aspect, there is provided a method of making a cutting element comprising a polycrystalline diamond (PCD) cutting table and a cemented carbide substrate, comprising:

a) placing a cemented carbide substrate with particulate diamond and cobalt catalyst and binder particles on top of the substrate within a canister;
b) sintering the contents of the canister to form a cutting element comprising a polycrystalline diamond table directly bonded to a cemented tungsten carbide substrate;
c) cutting the formed PCD cutting table from the substrate, and retaining the cemented carbide substrate;
d) using acid to leach cobalt from the PCD cutting table;
e) forming grooves into a first surface of the PCD cutting table
f) applying a metal or alloy layer onto the PCD cutting table by cold isostatic pressing so that the metal or alloy layer follows the grooved profile of the PCD cutting table; and
g) brazing the metal or alloy layer to the substrate retained in step (c) using a brazing filler layer.

DETAILED DESCRIPTION

In certain embodiments, the metal or alloy layer and the first surface of the cutting table are each provided with depressions therein and/or projections therefrom, which depressions and/or projections co-operate with each other. Optionally the co-operating shapes of metal or alloy layer and the cutting table provide an interference or friction fit between the two parts.

The co-operating shapes of the metal or alloy layer and the first surface of the cutting table substantially prevent relative movement therebetween. By this we mean relative movement in any direction relative to each other, e.g. relative rotation, relative lateral movement, or relative movement towards or away from each other away from their surface of contact.

In some embodiments not only the first surface of the metal or alloy layer, but also the opposing surface of the metal or alloy layer is provided with depressions therein and/or projections therefrom, so that the first surface and the opposing surface of the metal or alloy layer follows the profile of the depressions and/or projections in the cutting table and/or substrate.

The metal or alloy layer is located between the first surface of the super-hard cutting table and the first surface of the substrate, and it may be in direct contact with at least the first surface of the super-hard cutting table, or an intermediate layer may be present.

The superhard cutting table may, as a specific example, be substantially disc-shaped. The substrate may be substantially cylindrical, and where the cutting table is disc shaped, a cylindrical substrate may be of substantially the same diameter as the disc shaped cutting table and/or may be coaxial therewith.

The metal or alloy layer may be in contact with the superhard cutting table and co-operatively shaped therewith substantially to prevent relative movement therebetween. It may additionally be in contact with the first surface of the substrate. Alternatively one or more intermediate members may separate the metal or alloy layer from the said first surface of the substrate. The metal or alloy layer may for some applications, be co-operatively shaped with the substrate surface substantially to prevent movement relatively therebetween. More generally where the first surface of the metal or alloy layer is in contact with the first surface of the substrate those first surfaces are chemically joined to each other, for example by brazing, soldering or welding or the like, or by adhesive bonding. In these cases there is a mechanical (but no chemical) join between the cutting table and the metal or alloy layer, as a result of their co-operating shaped profiles, and a chemical (brazed or the like) bond between the metal or alloy layer and the substrate Where the superhard cutting table is substantially disc shaped, and has depressions and/or projections, therein, these may, in one embodiment, be in the form of an array of radially directed depressions or projections, e.g. in the layout of spokes of a wheel. These depressions or projections, may or may not start from the centre of the disc, and may or may not reach the periphery of the disc. The depressions or projections, may be of similar or different length.

Where the superhard cutting element is provided with depressions, these may be in the form of grooves for example. As one alternative, there may be a single depression, e.g. circular depression in the cutting element.

Where the superhard cutting element is provided with projections, these may be in the form of ridges for example, or may be a single projection e.g. a circular nipple shaped projection.

Where the cutting element is provided with one or more depressions, e.g. grooves, these may have an undercut shape; by this we mean the depression has side surfaces that incline away from each other in the direction into the thickness of the superhard cutting element. This shape may advantageously enhance a mechanical interference fit between the superhard cutting element and the metal or alloy layer.

Where the cutting element is provided with one or more projections, these may have an undercut outwardly facing surface. This may be explained as the projections having side surfaces that incline away from each other in the direction out of the thickness of the superhard cutting element.

Any suitable superhard material may be used for the superhard cutting element. As examples, there may be mentioned polycrystalline diamond and cubic boron nitride (cBN).

The superhard cutting element may contain catalyst/solvent material from the manufacture of the superhard cutting table, or may be partially or substantially depleted of such catalyst material, either throughout or in parts only of the superhard cutting element. For embodiments in which the super-hard cutting table is substantially depleted of catalyst/solvent material the metal or alloy layer that is mechanically secured thereto provides an advantageous means of attachment of the cutting table to the substrate, since it is known that such catalyst/solvent depleted materials, while typically providing enhanced thermal stability, are generally difficult to bond chemically themselves, e.g. by brazing, soldering, welding or the like, to substrates.

Where the superhard cutting table comprises PCD, any catalyst/solvent present may comprise, for example, cobalt, nickel, iron, manganese or an alloy containing one or more such metals. Where the superhard cutting table comprises cBN, the catalyst/solvent may comprise, for example, aluminium, alkali metals, cobalt, nickel, tungsten or the like.

Any suitable material may be used for the substrate. In some embodiments it is a material that is readily bonded by brazing, soldering or welding. To this end, the substrate material may comprise a metal, for example it may be a cemented metal carbide such as tungsten carbide. The cemented metal carbide substrate may contain residue catalyst material such as cobalt or the like from manufacture of the carbide substrate.

The metal or alloy layer may be applied to the superhard cutting table by any suitable method. To this end it may be any suitable configuration and is generally a layer of uniform thickness. The metal or alloy layer may be pressed against the first surface of the superhard cutting table. The pressing may be achieved by an externally applied pressing force or by an internal drawing force. A number of methods may be mentioned as suitable for pressing the metal or alloy layer against the cutting table. These include isostatic pressing, mechanical deep drawing in a flexible mould, and metal spinning. In embodiments of this invention we have found that a convenient pressing technique is isostatic pressing, e.g. CIP, (cold isostatic pressing) or HIP (hot isostatic pressing) against the cutting table. Such pressing methods result in the metal or alloy layer following the profile of the cutting table. Where the cutting table includes depressions or projections, for example grooves, including undercut grooves, the metal or alloy layer deforms, under the pressing process to follow that depressed, projecting, or grooved surface. In this instance, the metal or alloy layer after deformation may substantially retain its original thickness in the deformed area, merely deforming to follow the cutting table profile. Similarly the metal or alloy layer may be a layer that prior to application to the cutting table is substantially uniform in thickness, and after application to the cutting table, e.g. by a pressing method which deforms it to follow the profiled of the cutting table and substrate, remains of substantially uniform thickness, often substantially the same thickness after the pressing process, the layer merely changing its profile to follow the profile of the cutting table and substrate. These pressing or forming techniques are a simple and convenient way of achieving mechanical securement of the metal or alloy layer to the cutting table, which metal layer may then be secured, for example brazed to the substrate. This provides a convenient means of consequently securing a cutting table to a substrate, even when the composition of that cutting table is such as to make securement to the substrate by any conventional method involving brazing, welding, adhesion or the like difficult.

As another possibility for applying the metal or alloy layer to the cutting table, the metal or alloy layer may be formed in-situ. For example it may be formed in-situ using a powder forming process in a mould, for example powder metallurgy, the mould being such that the in-situ formed metal or alloy layer is co-operatingly shaped to fit against cutting table so as to follow the shape thereof, including for example following the profile of any depressions or projections therein.

Any suitable material may be used for the metal or alloy layer. As examples there may be mentioned Nb, Mo, Ta, rare earth super-alloys, Hastelloy™ super-alloys, and hardened steel. One factor in deciding on the choice of metal or alloy layer is the ductility and strength of the material; sufficient ductility and strength to withstand metal forming is advantageous for applications where the metal or alloy layer is deformed, e.g. where the metal or alloy layer is in the form of layer which is pressed, for example CIPed, so as to follow the profile of a cutting table containing depressions or projections.

Where the metal or alloy layer is provided as a metal or alloy layer, a typical minimum thickness for the metal or alloy layer is 0.05 mm, or 0.1 mm or 0.15 mm, and a typical maximum thickness for the metal or alloy layer is 0.5 mm or 0.4 mm or 0.3 mm. For example, the metal or alloy layer may be 0.5-0.25 mm thick, for example about 0.2 mm thick.

The cutting table to which the metal layer is applied may be at least twice, or at least 2.5, or at least 3 or at least 3.5 times as thick as the maximum thickness of the metal layer.

The metal or alloy layer used in the some embodiments may be a discrete part that is provided separately from the superhard cutting table, and then positioned thereon and formed (e.g. CIPed) to follow the profile of the superhard cutting table, thereby forming the interference fit between the metal or alloy layer and the superhard cutting table. To this end, the metal or alloy layer may be a self-supporting layer.

The bonding of the metal or alloy layer to the substrate may be by brazing, soldering or welding or adhesion, as examples. The substrate may comprise a cemented metal carbide, for example tungsten carbide.

The super-hard cutting table may, for example, be substantially disc shaped with two substantially circular major surfaces and a curved edge surface. Other shapes are also envisaged, for example straight-sided cutting tables, on straight-sided or box shaped substrates. Methods discussed herein may comprise forming depressions and/or projections in a first major surface of the disc shaped superhard cutting table and may comprise forming the metal or alloy layer, e.g. metal or alloy layer to follow the profile of these depressions and/or projections, thereby to form an interference fit with a first surface of a metal or alloy layer, An opposed major surface of the metal may then be bonded, e.g. chemically bonded, for example by brazing, soldering or welding, or adhesive or the like to the first surface of the substrate, which for a substantially cylindrical substrate may be an end face of the substrate. The metal or alloy layer may be any suitable shape, for example it may be a substantially planar plate that is deformed, e.g. pressed or drawn into a surface configuration to co-operate with that of the first surface of the cutting table, e.g. with depressions or projections therein.

Where the cutting table is substantially disc shaped, typical thicknesses for the disc are in the range 0.5 mm to 2 mm, though thinner and thicker cutting table discs are also envisaged. Also typical diameters for the cutting table disc are in the range 5-20 mm, though again smaller and large diameters are envisaged. Where the substrate is substantially cylindrical to match the periphery of the disc shaped cutting table, the substrate typically has a diameter to match that of the cutting table.

In some embodiments the super-hard cutting table comprises PCD or cBN which has been at least partially depleted of catalyst/solvent, and in some embodiments substantially completely depleted of catalyst/solvent. This catalyst/solvent depletion may be achieved, for example, by acid leaching or the like. The method of joining a super-hard cutting table to a substrate using an intermediate member of metal that is mechanically secured, e.g. by an interference fit, to the super-hard cutting element, and then secured (e.g. by a chemical bond such as brazing or the like) to a cemented carbide substrate is advantageous for forming joints between PCD or cBN super-hard cutting tables that have been depleted of catalyst/solvent either partially or completely, since such catalyst/solvent depleted super-hard materials are known to be difficult to chemically bond by standard techniques, e.g. by brazing, soldering or welding.

BRIEF DESCRIPTION OF DRAWINGS

Some embodiments will now be described by way of example only and with reference to the accompanying drawings, wherein:

Referring to the drawings, FIG. 1 shows component parts of a cutting element 1 according to one embodiment. The components are a cobalt-depleted PCD cutting table 3, a metal or alloy layer 5 and a cemented tungsten carbide substrate 7. In FIG. 1 the cutting table 3 is shown mechanically secured/joined to the metal or alloy layer 5, but for clarity that combination is shown separated from the cemented carbide substrate. The PCD cutting table 3 is generally disc shaped, and includes depressions in the form of a radial array of six grooves 9 on its underside surface in the orientation shown. Grooves 9 have been laser cut into the PCD cutting table 1. The PCD table 3 is 0.7 mm thick and 13 mm in diameter. The grooves 9 are 0.5 mm wide, and 0.5 mm in depth. Mechanically secured to the underside surface of PCD cutting table 3 is a Nb metal or alloy layer 5. This metal or alloy layer 5 is, like the PCD cutting table 3, disc shaped, and is coterminous with the cutting table 3. The metal or alloy layer 7 is substantially thinner than the disc shaped PCD cutting table 3, and in this embodiment is thinner than the groove in the PCD cutting table. In this embodiment the metal or alloy layer is 0.2 mm thick. The metal or alloy layer 7 includes depressions in a similar manner to the PCD cutting table, these depressions, similarly being in the form of a radial array of grooves 11 (only one is referenced in the figure for clarity). The grooves 11 in the cutting table co-operate with respective grooves 9 in the PCD cutting table 3 and thereby substantially prevent relative movement between the PCD cutting table 3 and the metal or alloy layer 5. The grooves 9 and 11 in the PCD cutting table 3 and metal or alloy layer 5 respectively have undercut edges which enhance the co-operation of the two layers, and the mechanical securement interference fit therebetween.

Figure 1:
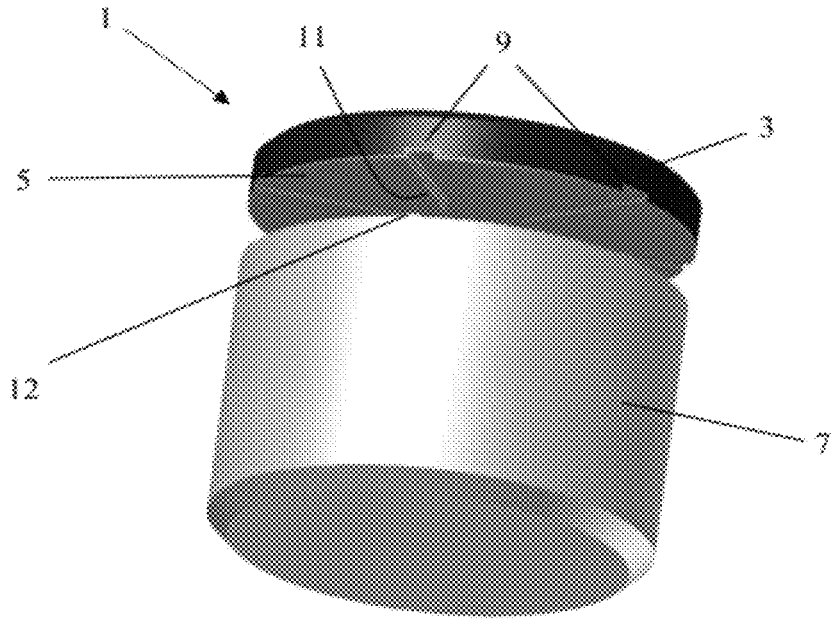
FIG. 1 is a perspective view of component parts of a cutting element according to one embodiment.

The metal or alloy layer 5 has been applied to the PCD cutting table 3 by cold isostatic pressing. Thus the metal or alloy layer 5 is mechanically secured to the cutting table 3 by an interference or friction fit between the co-operating, interlinked radial array of grooves 9 and 11.

The metal disc-shaped layer 5 is then joined by brazing to a substantially cylindrical cemented tungsten carbide substrate 15, this substrate 15 containing cobalt binder. The diameter of the cylindrical cemented tungsten carbide substrate 15 is substantially the same as the diameter of the PCD cutting disc 3 and the diameter of the metal or alloy layer 5 that is mechanically secured to the PCD cutting table 3. Joining of the metal or alloy layer 5 to the tungsten carbide substrate 7 by brazing is a straightforward brazing joint. As would be evident to the person skilled in the art, such a metal to metal join is substantially easier to make, and once formed is substantially more reliable than similarly welded, soldered, or brazed joint would be if made directly between a cemented carbide substrate and a superhard cutting table, particularly where the superhard cutting table has been depleted of binder to render it thermally stable.

Figure 2:
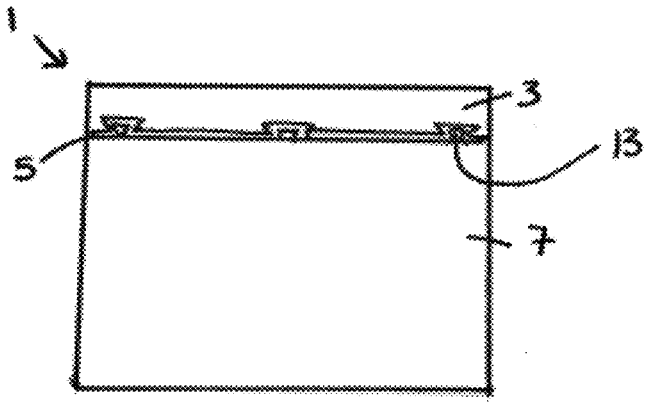
FIG. 2 is a side elevation of the cutting elements of FIG. 1 with the component parts secured to each other.

The cutting element 1 consisting of cutting table 3 with mechanically secured metal or alloy layer 5, brazed to the cemented tungsten carbide substrate 7 is shown in side view in FIG. 2. The tungsten carbide substrate 7 may be profiled to fit approximately within the grooves 11 in the metal or alloy layer 5 to facilitate the braze, or the small regions within the grooves 11 in the metal or alloy layer 5. This is shown as features 12 in FIG. 3. Alternatively these grooves may simply be filled after brazing with brazing filler 13.

Figure 3:
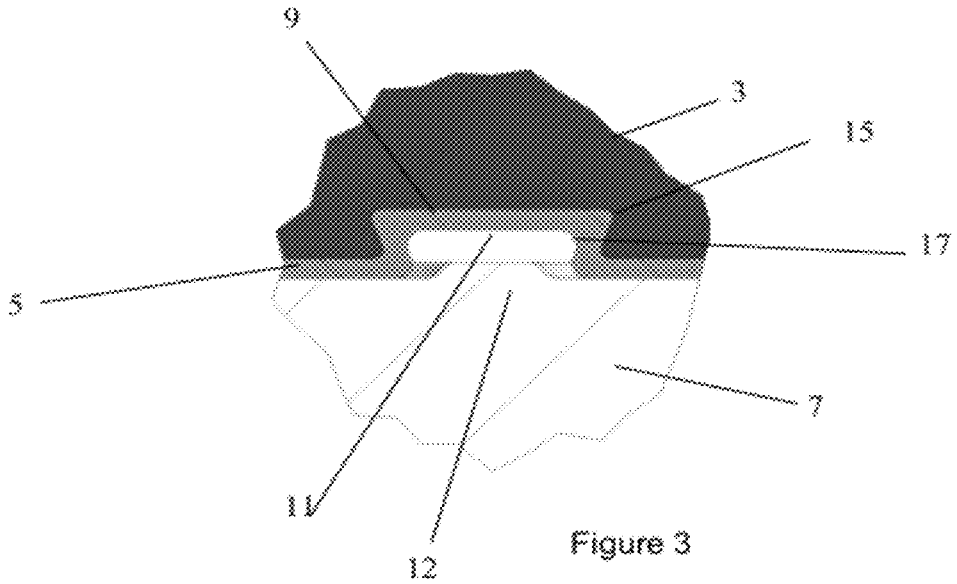
FIG. 3 is an enlarged sectional view through the join region between the component parts of the assembled cutting element of FIG. 2.

FIG. 3 is an enlarged sectional view through the join region between the PCD cutting table 3 and the cemented carbide substrate 7, showing the intervening metal or alloy layer 5, and the co-operating grooves 9 and 11 in the PCD table 3 and metal or alloy layer 5 respectively. The figure also illustrated clearly the undercut edges 15 and 17 of the PCD table 3 and the metal or alloy layer 5 respectively. This undercut edge profile 15/17 enhances the mechanical interference or friction fit between the PCD cutting table 3 and the metal or alloy layer 5.

Figure 4:
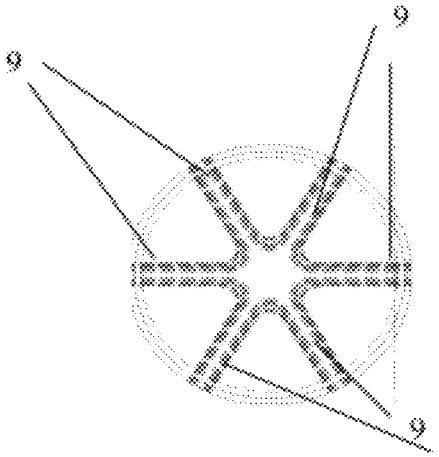
FIG. 4 is a plan view, showing hidden detail, of the cutting element 1 of FIGS. 1 and 2.

FIG. 4, which is a plan view, showing hidden detail, of the cutting element 1 of FIGS. 1 and 2 showing the radial array of six grooves 9 cut into the underside surface of the PCD table 3.

In order to make the cutting element shown in FIGS. 1-4, a PCD cutting table/WC substrate cutting element is made by the following steps:

a) in the conventional way, a solid preformed cemented carbide substrate is placed with particulate diamond and cobalt catalyst/binder particles on top of it into a canister and the canister s submitted to HPHT conditions to form a cutting element comprising a PCD diamond table directly bonded to a cemented tungsten carbide substrate;

b) cut the formed PCD cutting table from the substrate, but retain the cemented carbide substrate;

c) acid leach the cobalt from the PCD cutting table;

d) laser ablate six radial grooves of width 0.5 mm, radial length 4 mm and depth 0.5 mm into the PCD cutting table in the orientation shown in FIG. 4;

e) apply a 0.2 mm thick metal or alloy layer of Nb onto the PCD cutting table by cold isostatic pressing so that the metal or alloy layer follows the grooved profile of the PCD cutting table, and retains a thickness of 0.2 mm after the pressing process;

f) braze the Nb metal or alloy layer to the substrate retained in step (b) using a brazing filler layer.

The cutting elements shown in FIGS. 1-4 may be used in an earth boring rotary drill bit for example. Typically such a drill bit body is made from tungsten carbide, and includes a plurality of blades that extend out from a rotating axis of the drill bit, and are also formed of tungsten carbide. A plurality of PCD cutting elements according to FIGS. 1-4 may be arranged along the length of each blade. The cutting elements may be sited within sockets formed along each blade, and are generally brazed into those sockets.

Figure 5C:
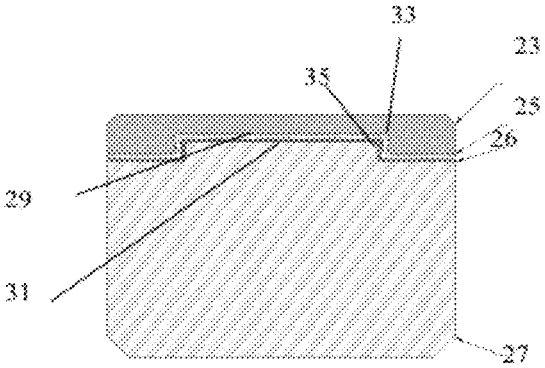
FIG. 5*c* is a side sectional view through line B-B of FIG. 5*b;*
Figure 5B:
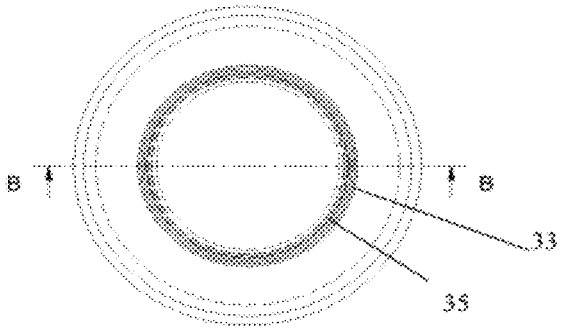
FIG. 5*b* is a plan view, showing hidden detail, of the component parts of FIG. 5*a* assembled.
Figure 5A:
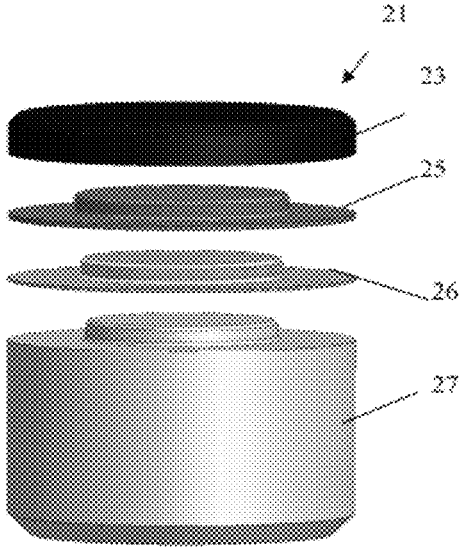
FIG. 5*a* is a perspective view of component parts of a cutting element according to another embodiment.

FIG. 5*a* shows component parts of a cutting element 21 according to another embodiment. The components are a cobalt-depleted PCD cutting table 23, a Nb metal or alloy layer 25, a braze layer 26 and a cemented tungsten carbide substrate 27. As in the embodiment of FIGS. 1-4, the PCD cutting table 23 is disc shaped, but in this case it includes a single depression in the form of a single circular depression 29 on its underside surface in the orientation shown. The depression 29 has been laser cut into the PCD cutting table 1. As before the PCD table 23 is 0.7 mm thick and 13 mm in diameter. The circular depression is 0.5 mm in depth. Mechanically secured to the underside surface of PCD cutting table 23 is a Nb metal or alloy layer 25. This metal or alloy layer 25 is, like the PCD cutting table 23, disc shaped, and is coterminous with the cutting table 23. The metal or alloy layer 25 is substantially thinner than the disc shaped PCD cutting table 23, and in this embodiment is thinner than the groove in the PCD cutting table. In this embodiment as before the metal or alloy layer is 0.2 mm thick. The metal or alloy layer 25 includes a circular depression 31 corresponding to that in the PCD cutting table. The depression 31 in the cutting table co-operate with respective circular depression 29 in the PCD cutting table 23 and thereby substantially prevent relative movement between the PCD cutting table 23 and the metal or alloy layer 25. The depressions 29 and 31 in the PCD cutting table 23 and metal or alloy layer 25 respectively have undercut edges 33, 35 which enhance the co-operation of the two layers, and the mechanical securement interference fit therebetween.

The metal or alloy layer 25 has been applied to the PCD cutting table 23 by cold isostatic pressing. Thus the metal or alloy layer 25 is mechanically secured to the cutting table 23 by an interference or friction fit between the co-operating, circular depressions 29 and 31 in the cutting table 23 and CIPed Nb layer 25 respectively. The depression 29 in the PCD cutting table 23 has an undercut profile 33. This means the sides of the depression 29 lean away from each other in the direction into the thickness of the PCD cutting table 23. When the metal or alloy layer 25 is CIPed onto the cutting table 23 it follows this undercut profile 33, so itself presents an undercut profile 35.

In the same way as for the embodiment of FIGS. 1-4, the metal disc-shaped layer 25 is then joined by brazing to a substantially cylindrical cemented tungsten carbide substrate 27, this substrate 27 containing a cobalt-containing binder. Brazing is accomplished using a braze layer 26 in a conventional manner.

Figure 6C:
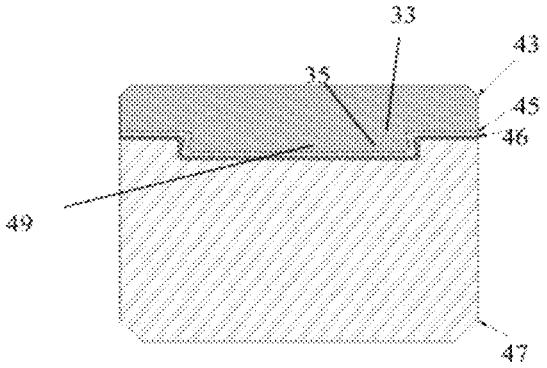
FIG. 6*c* is a side sectional view through line B-B of FIG. 6*b*.
Figure 6B:
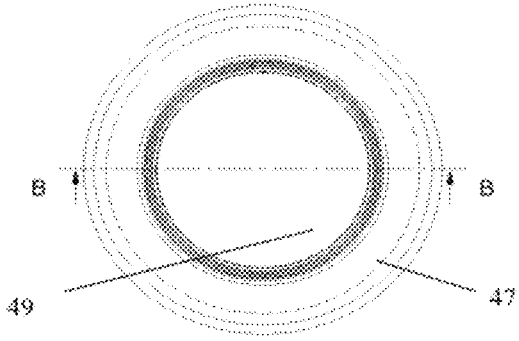
FIG. 6*b* is a plan view, showing hidden detail, of the component parts of FIG. 6*a* assembled.
Figure 6A:
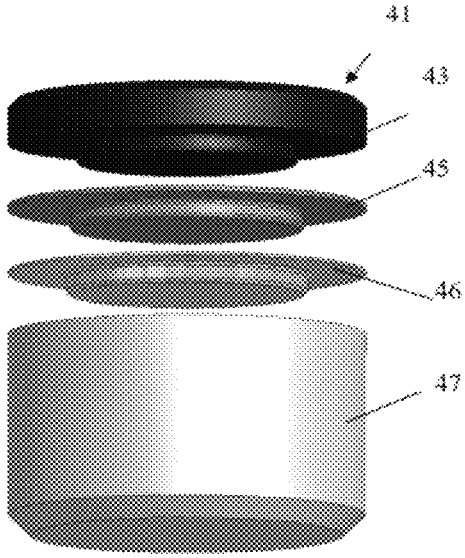
FIG. 6*a* is a perspective view of component parts of a cutting element according to yet another embodiment.

FIGS. 6*a*-6*c* shows a cutting element 41 that is similar to that shown in FIGS. 5*a*-5*c*, except in this case the PCD cutting table 43 is provided with a circular projection or nipple 49 onto which is CIPed a Nb metal or alloy layer 45, which is then secured to a tungsten carbide substrate 47 by a braze layer 46. The projecting nipple 49 has undercut sides, i.e. the sides are inclined away from each other in the direction out of the cutting table and into the substrate. The CIPed Nb layer 45 follows the profile of the nipple 49. This enhances an interference fit.

In each case in FIGS. 5*a*-*c* and 6*a*-*c* the profiled PCD layer 23 and 43 respectively may be laser cut into shape. The tungsten carbide substrate 27, 47 may be similarly profiled to fit approximately around or into the profiled PCD layer with CIPed metal or alloy layer thereon in order to facilitate the braze.

The invention claimed is:

1. A cutting element comprising a super-hard cutting table, a substrate and a metal or alloy layer; the superhard cutting table, the substrate and the metal or alloy layer each having a first surface, the said first surface of the cutting table being joined to the said first surface of the substrate by means of the metal or alloy layer, the metal or alloy layer being located between the said first surfaces of the super-hard cutting table and the substrate so that the first surface of the metal or alloy layer faces the first surface of the cutting table, wherein (i) the first surface of the cutting table is provided with depressions therein and/or projections therefrom, which depressions or projections have undercut surfaces whereby for a depression the side surfaces of the depression incline away from each other in the direction into the thickness of the superhard cutting table, and for a projection the outwardly facing side surfaces of the projection incline away from each other in the direction out of the thickness of the superhard cutting table; and (ii) the first surface of the metal or alloy layer is similarly provided with undercut projections and/or depressions which co-operate with those of the cutting table, the co-operative shaping of the undercut projections and depressions in the cutting table and the metal or alloy layer substantially preventing relative movement between the cutting table and the metal or alloy layer, in any direction, whereby there is a mechanical join between the cutting table and the metal or alloy layer, the metal or alloy layer having been isostatically pressed towards the first surface of the cutting table whereby both the first surface of the metal or alloy layer and the opposing surface of the metal or alloy layer follow the undercut profile of the depressions and/or projections in the cutting table.

2. A cutting element according to claim 1, wherein at least the first surface of the metal or alloy layer and the first surface of the cutting table are each provided with depressions therein and/or projections therefrom, which depressions and/or projections co-operate with each other.

3. A cutting element according to claim 2, wherein not only the first surface of the metal or alloy layer, but also the opposing surface of the metal or alloy layer is provided with depressions therein and/or projections therefrom, so that the first surface and the opposing surface of the metal or alloy layer follow the profile of the depressions and/or projections in the cutting table and/or substrate.

4. A cutting element according to claim 1, wherein the metal or alloy layer is an interference fit with the superhard cutting table.

5. A cutting element according to claim 1, wherein the metal or alloy layer is brazed, soldered or welded to the first surface of the substrate.

6. A cutting element according to claim 1, wherein the thickness of the cutting table is at least twice that of the metal or alloy layer.

7. A cutting element according to claim 1, wherein the thickness of the metal or alloy layer is at most 6 mm.

8. A cutting element according to claim 1, wherein the super-hard cutting element comprises polycrystalline diamond (PCD).

9. A cutting element according to claim 1, wherein the substrate comprises a cemented carbide.

10. A cutting element according to claim 1, wherein the cutting table is substantially disc-shaped, and the substrate is substantially cylindrical.

* * * * *